US009200533B2

(12) United States Patent
Donkada et al.

(10) Patent No.: US 9,200,533 B2
(45) Date of Patent: Dec. 1, 2015

(54) ENTHALPY DETERMINING APPARATUS, SYSTEM AND METHOD

(71) Applicant: General Electric Company, Schenectady, NY (US)

(72) Inventors: Santhosh Donkada, Bangalore (IN); Indrajit Mazumder, Bangalore (IN); Bhaskar Pemmi, Bangalore (IN); Rajarshi Saha, Bangalore (IN); Anil Kumar Sharma, Bangalore (IN)

(73) Assignee: General Electric Company, Schenectady, NY (US)

( * ) Notice: Subject to any disclaimer, the term of this patent is extended or adjusted under 35 U.S.C. 154(b) by 517 days.

(21) Appl. No.: 13/680,413

(22) Filed: Nov. 19, 2012

(65) Prior Publication Data

US 2014/0140806 A1 May 22, 2014

(51) Int. Cl.

| | |
|---|---|
| ***F01K 17/02*** | (2006.01) |
| ***F01D 25/00*** | (2006.01) |
| ***F01D 25/24*** | (2006.01) |
| ***F01K 13/00*** | (2006.01) |
| ***F01K 13/02*** | (2006.01) |

(52) U.S. Cl.

CPC ..... *F01D 25/00* (2013.01); *F01D 25/24* (2013.01); *F01K 13/003* (2013.01); *F01K 13/02* (2013.01)

(58) Field of Classification Search

CPC ..... F01D 25/24; F01D 25/00; F01D 13/003; F01K 13/003

USPC ..... 702/136

See application file for complete search history.

(56) References Cited

U.S. PATENT DOCUMENTS

| | | | | |
|---|---|---|---|---|
| 4,409,825 | A * | 10/1983 | Martin et al. | 73/152.27 |
| 5,061,431 | A | 10/1991 | Silvestri, Jr. | |
| 6,643,605 | B1 | 11/2003 | Endries et al. | |
| 7,328,624 | B2 | 2/2008 | Gysling et al. | |
| 7,634,385 | B2 | 12/2009 | Smith | |
| 8,091,361 | B1 | 1/2012 | Lang | |
| 8,096,140 | B2 | 1/2012 | Seem | |
| 8,097,679 | B2 | 1/2012 | Resconi et al. | |
| 8,113,272 | B2 | 2/2012 | Vinegar | |
| 2011/0038712 | A1 * | 2/2011 | Yang | 415/118 |
| 2011/0173991 | A1 | 7/2011 | Dean | |
| 2011/0179799 | A1 | 7/2011 | Allam et al. | |
| 2011/0280933 | A1 | 11/2011 | Preston et al. | |
| 2011/0283704 | A1 | 11/2011 | Hatamiya et al. | |
| 2011/0293788 | A1 | 12/2011 | Haynes et al. | |
| 2011/0305623 | A1 | 12/2011 | Doty | |
| 2012/0000175 | A1 | 1/2012 | Wormser | |
| 2012/0006025 | A1 | 1/2012 | Koyama et al. | |

FOREIGN PATENT DOCUMENTS

| | | | |
|---|---|---|---|
| EP | 2254946 | B1 | 2/2006 |
| EP | 2402657 | A1 | 12/2009 |
| JP | 62050653 | A | 3/1987 |

* cited by examiner

*Primary Examiner* — Ninh H Nguyen

(74) *Attorney, Agent, or Firm* — Ernest G. Cusick; Hoffman Warnick LLC

(57) ABSTRACT

Various embodiments include apparatuses and related methods for determining the enthalpy of steam. In some embodiments, an apparatus includes: an extraction conduit fluidly connected with a steam turbine section, the extraction conduit for obtaining wet steam from the steam turbine section; a mixing chamber fluidly connected with the extraction conduit; an injector fluidly connected with the mixing chamber, the injector for providing dry steam to the mixing chamber for mixing with the wet steam from the steam turbine section to produce a sample mixture; and an enthalpy detection system fluidly connected with the mixing chamber, the enthalpy detection system configured to determine an enthalpy of the sample mixture.

18 Claims, 3 Drawing Sheets

ENTHALPY DETERMINING APPARATUS, SYSTEM AND METHOD

FIELD OF THE INVENTION

The subject matter disclosed herein relates to power systems. More particularly, the subject matter relates to steam-based power systems.

BACKGROUND OF THE INVENTION

Conventional approaches for determining the thermodynamic efficiency of a steam turbine section (e.g., a low pressure (LP) steam turbine section) are deficient. Determining the thermodynamic efficiency of a turbine section can be performed by calculating the enthalpy of steam exhausting from that turbine section (e.g., the LP section). However, much of the time that exhaust steam is wet (saturated) steam. Calculating the enthalpy of this wet steam can be difficult because the temperature and pressure of wet steam are not independent variables. Conventional approaches include determining another, independent quantity related to the wet steam (e.g., moisture fraction). However, these conventional approaches can be time-consuming, ineffective or both.

BRIEF DESCRIPTION OF THE INVENTION

Various embodiments include apparatuses and related methods for determining the enthalpy of steam. In some embodiments, an apparatus includes: an extraction conduit fluidly connected with a steam turbine section (e.g., an LP steam turbine section), the extraction conduit for obtaining wet steam from the steam turbine section; a mixing chamber fluidly connected with the extraction conduit; an injector fluidly connected with the mixing chamber, the injector for providing dry steam to the mixing chamber for mixing with the wet steam from the steam turbine section to produce a sample mixture; and an enthalpy detection system fluidly connected with the mixing chamber, the enthalpy detection system configured to determine an enthalpy of the sample mixture.

A first aspect of the invention includes an apparatus having: an extraction conduit fluidly connected with a steam turbine section, the extraction conduit for obtaining wet steam from the steam turbine section; a mixing chamber fluidly connected with the extraction conduit; an injector fluidly connected with the mixing chamber, the injector for providing dry steam to the mixing chamber for mixing with the wet steam from the steam turbine section to produce a sample mixture; and an enthalpy detection system fluidly connected with the mixing chamber, the enthalpy detection system configured to determine an enthalpy of the sample mixture.

A second aspect of the invention includes a method of determining an enthalpy of steam from a steam turbine section, the method including: providing a mixing chamber fluidly connected with the steam turbine section and an injector; actuating the injector to introduce dry steam from a dry steam source to the mixing chamber, the actuating of the injector creating a vacuum condition within the mixing chamber, the vacuum condition drawing wet steam from the steam turbine section into the mixing chamber to mix with the dry steam and form a sample mixture; and determining an enthalpy of the sample mixture.

A third aspect of the invention includes a system having: a steam turbine section; an extraction conduit fluidly connected with the steam turbine section, the extraction conduit for obtaining wet steam from the steam turbine section; a mixing chamber fluidly connected with the extraction conduit; an injector fluidly connected with the mixing chamber, the injector for providing dry steam to the mixing chamber for mixing with the wet steam from the steam turbine section to produce a sample mixture; and an enthalpy detection system fluidly connected with the mixing chamber, the enthalpy detection system configured to determine an enthalpy of the sample mixture.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
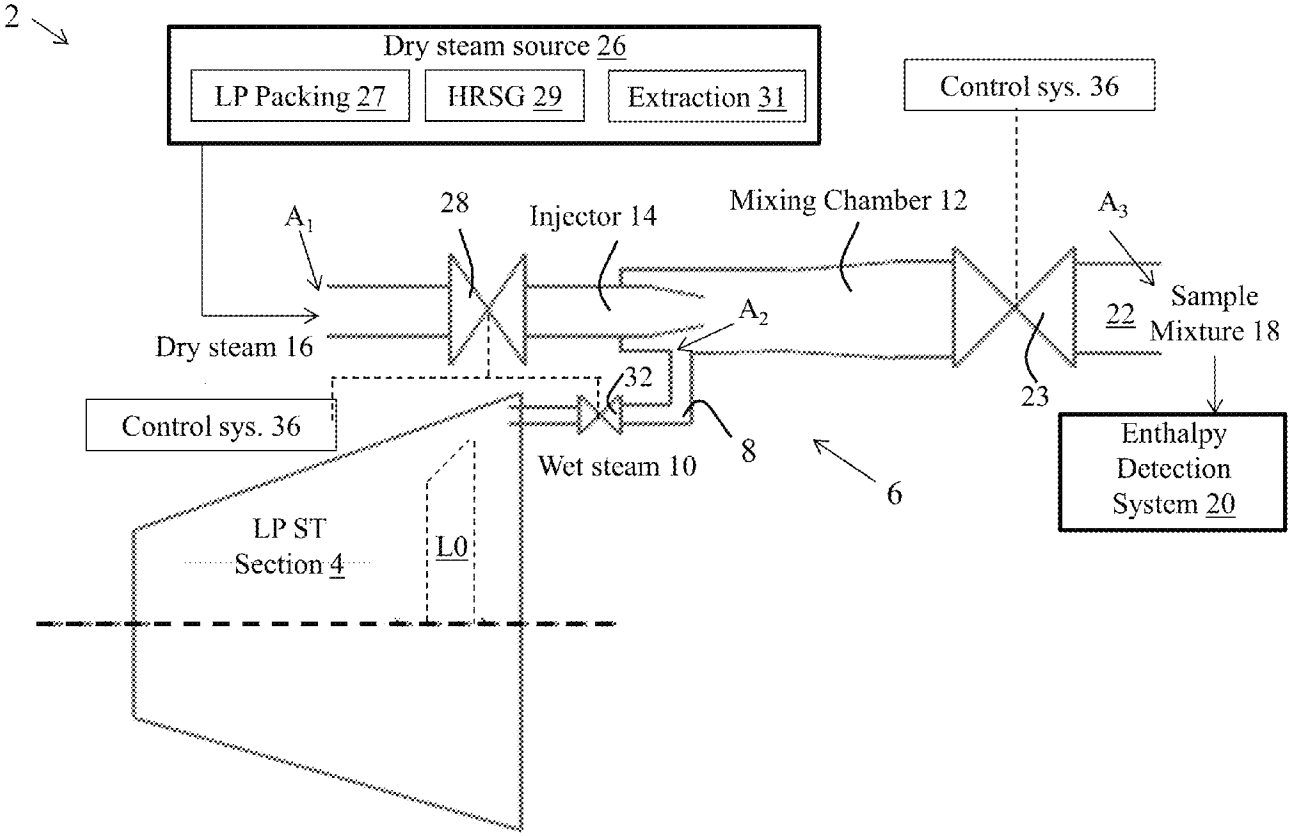
FIG. 1 shows a schematic depiction of a system according to various embodiments of the invention.

It is noted that the drawings of the invention are not necessarily to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

As noted, the subject matter disclosed herein relates to power systems. More particularly, the subject matter relates to steam-based power systems.

As described herein, conventional approaches for determining the thermodynamic efficiency of a steam turbine section (e.g., a low pressure (LP) steam turbine section) are deficient. Determining the thermodynamic efficiency of a turbine section (e.g., LP steam turbine section) can be performed by calculating the enthalpy of steam exhausting from that turbine section. However, much of the time, that exhaust steam is wet (saturated) steam. Calculating the enthalpy of this wet steam can be difficult because the temperature and pressure of wet steam are not independent variables. Conventional approaches include determining another, independent quantity related to the wet steam (e.g., moisture fraction). However, these conventional approaches can be time-consuming, ineffective or both.

In contrast to the conventional approaches, various embodiments of the invention include apparatuses, systems and related methods for efficiently determining the enthalpy of steam from a turbine section (e.g., an LP turbine section). Various embodiments of the invention mix wet steam from the turbine section with dry steam to efficiently determine the enthalpy of the wet steam. These various embodiments employ an injector which introduces the dry steam into a mixing chamber for mixing with the wet steam from the turbine section. The mixing chamber is fluidly connected with the injector and the turbine section (e.g., via a conduit). When the injector introduces the dry steam to the mixing chamber, the pressure differential between the lower pressure dry steam and higher pressure wet steam (in the turbine section) creates a vacuum in the mixing chamber. This vacuum draws the wet steam into the mixing chamber, where it mixes with the dry steam. Various embodiments of the invention include an enthalpy detection/determining system which can measure the enthalpy of that mixture and determine an enthalpy of the wet steam, based upon the known conditions of the dry steam introduced into the mixing chamber (which forms part of the mixture).

In various particular embodiments, an apparatus is disclosed. The apparatus can include an extraction conduit fluidly connected with a low pressure (LP) steam turbine section. The extraction conduit can obtain wet steam from the LP steam turbine section (caused by the vacuum effect described herein). The apparatus can also include a mixing chamber fluidly connected with the extraction conduit, and an injector fluidly connected with the mixing chamber. The injector provides dry steam to the mixing chamber for mixing with the wet steam from the LP steam turbine section to produce a sample mixture. As described herein, the injector creates a vacuum within the mixing chamber to draw the wet steam from the LP steam turbine section. The apparatus can further include an enthalpy detection system fluidly connected with the mixing chamber. The enthalpy detection system is configured to determine an enthalpy of the sample mixture, e.g., by calculating the enthalpy of the sample mixture, while accounting for the known enthalpy of the dry steam introduced by the injector.

Various other particular embodiments of the invention include a method of determining an enthalpy of steam from a low pressure (LP) steam turbine section. The method can include: a) providing a mixing chamber fluidly connected with the LP steam turbine section and an injector; b) actuating the injector to introduce dry steam from a dry steam source to the mixing chamber. The actuating of the injector creates a vacuum condition within the mixing chamber, where the vacuum condition draws wet steam from the LP steam turbine section into the mixing chamber to mix with the dry steam and form a sample mixture; and c) determining an enthalpy of the sample mixture. It is understood that the method can further include: d) comparing the enthalpy of the sample mixture with a known enthalpy of the dry steam to determine an enthalpy of the wet steam from the LP steam turbine section.

Various additional embodiments of the invention include a system. The system can include a low pressure (LP) steam turbine section and an extraction conduit fluidly connected with the LP steam turbine section. The extraction conduit can obtain wet steam from the LP steam turbine section. The system can also include a mixing chamber fluidly connected with the extraction conduit. Further, the system can include an injector fluidly connected with the mixing chamber, the injector for providing dry steam to the mixing chamber for mixing with the wet steam from the LP steam turbine section to produce a sample mixture. This system can also include an enthalpy detection system fluidly connected with the mixing chamber, where the enthalpy detection system is configured to determine an enthalpy of the sample mixture. The enthalpy detection system can also compare the enthalpy of the sample mixture with a known enthalpy of the dry steam to determine an enthalpy of the wet steam from the LP steam turbine section.

In these various embodiments, the determined enthalpy of the wet steam from the LP steam turbine section is used as an indicator of the thermal efficiency of that LP steam turbine section. Therefore, various embodiments of the invention provide apparatuses, methods and systems for determining a thermal efficiency of an LP steam turbine section.

Turning to FIG. 1, a system 2 is shown according to various embodiments of the invention. In some cases, the system 2 can include a steam turbine section (e.g., a low pressure steam turbine section, or simply, steam turbine section) 4 (shown including a last stage, or L0 bucket). Fluidly connected with the steam turbine section 4 is an apparatus 6 according to various embodiments of the invention. The apparatus 6 can include an extraction conduit 8 fluidly connected with the steam turbine section 4. The extraction conduit 8 can obtain wet steam 10 from the steam turbine section (caused by a vacuum effect described further herein) 4, e.g., from the last stage, or L0 bucket of the steam turbine section 4. The apparatus 6 can also include a mixing chamber 12 fluidly connected with the extraction conduit 8, and an injector 14 fluidly connected with the mixing chamber 12.

The injector 14 can provide dry steam 16 to the mixing chamber 12 for mixing with the wet steam 10 from the steam turbine section 4 to produce a sample mixture 18. In various cases, the dry steam 16 includes superheated steam, e.g., steam with an average temperature of approximately 300 degrees Celsius to approximately 400 degrees Celsius, e.g., approximately 350 degrees Celsius. As described herein, the injector 14 creates a vacuum within the mixing chamber 12 to draw the wet steam 10 from the steam turbine section 4.

The apparatus 6 can further include an enthalpy detection system 20 fluidly connected with the mixing chamber 12, e.g., via a conduit 22 having a valve 23. The enthalpy detection system 20 is configured to determine an enthalpy of the sample mixture 18, e.g., by calculating the enthalpy of the sample mixture 18, while accounting for the known enthalpy of the dry steam 16 introduced by the injector 14. In some embodiments, the enthalpy detection system 20 can include any conventional electrical, mechanical and/or electro-mechanical components configured to perform the enthalpy detection processes described herein. In various embodiments, the enthalpy detection system 20 includes one or more of a memory, a processor, a storage device, an input/output device, etc. In various embodiments, the enthalpy detection system 20 includes various detection systems for determining characteristics of the sample mixture 18, and comparing those characteristics with known (either stored or user-provided) characteristics of the dry steam 16 and/or the wet steam As shown, the apparatus 6 can also include a dry steam source 26 fluidly connected with the injector 14 for providing the dry steam 16 to the mixing chamber 12. In some cases, the dry steam source 26 includes at least one of a steam turbine section packing (e.g., a LP Packing) 27, a heat recovery steam generator (HRSG) 29 or an extraction location (Extraction) 31 of the steam turbine section 4.

The apparatus 6 also can also include a first control valve 28 fluidly connected with the dry steam source 26 (e.g., via another conduit 22) and the injector 14. The first control valve 28 is configured to control flow of the dry steam 16 from the dry steam source 26 to the injector 14. In various embodiments, the apparatus 6 can further include a second control valve 32 fluidly connected (e.g., via another conduit 22) with the extraction conduit 8. The second control valve 32 can be configured to control flow of the wet steam 10 from the steam turbine section 4 (e.g., into the mixing chamber 12).

The apparatus 6 can further include a control system 36 operably connected (e.g., via wireless and/or hard-wired connection) with the first control valve 28 and/or the second control valve 32 (and in some cases, valve 23). In various embodiments of the invention, the control system 36 includes a conventional turbomachine control system, which can include hardware and/or software components capable of performing the control processes described herein. In some embodiments, the control system 36 can include any conventional electrical, mechanical and/or electro-mechanical components configured to perform the control processes described herein. In various embodiments, the control system 36 includes one or more of a memory, a processor, a storage device, an input/output device, etc. In various embodiments, the control system 36 is configured to modify a position of at least one of the first control valve 28 or the second control valve 32. The control system 36 can modify the position (e.g., open, closed, partially open) of the first control valve 28 and/or the second control valve 32 by any conventional means, e.g., via mechanical actuation, electrical switching, and/or software-implemented actuation.

According to various embodiments of the invention, the injector 14 creates a vacuum condition within the mixing chamber 12 by accelerating the dry steam 16 as it provides the dry steam 16 to the mixing chamber 12. This lower pressure dry steam 16 (relative to the higher pressure wet steam 10) is injected into the mixing chamber 12 and accelerated to create a vacuum condition (pressure differential, caused by a static pressure drop) within the mixing chamber 12. This vacuum condition draws the wet steam 10 into the mixing chamber 12 from the steam turbine section 4. That is, the introduction of the dry steam 16 at high speed, e.g., approximately 400-500 meters/second (and more particularly approximately 430 meters/second) creates a static pressure drop across the outlet (shown as area A2) of the extraction conduit 8 (at the intersection of the extraction conduit 8 and mixing chamber 12). This static pressure drop draws fluid from the extraction conduit 8 (and consequently, the steam turbine section 4) into the mixing chamber 12 for mixing with the dry steam 16 from the dry steam source 26 to form the sample mixture 18.

Once mixed, the enthalpy of the sample mixture 18 can be tested by the enthalpy detection system 20, which can include one or more pressure measurement gauges, velocity (mass flow rate) gauges, temperature gauges, etc. Based upon a known enthalpy of the dry steam (e.g., pressure, mass flow rate and temperature), the enthalpy detection system 20 can determine an enthalpy of the sample mixture 18.

That is, as is known in the art, where an enthalpy of a first input fluid is known, and a resultant mixture of that first input fluid and a second unknown input fluid is known (e.g., measureable), the enthalpy of the unknown second input fluid can be calculated using conventional conservation of mass, conservation of momentum equations and/or conservation of energy equations.

In particular embodiments, the cross-sectional area of the outlet ($A_1$) of the injector 14 is known, the cross-sectional of the outlet ($A_2$) of the extraction conduit 8 is known, and the cross-sectional area of the mixing chamber ($A_3$) is known. In this case, the enthalpy detection system can calculate an enthalpy of the sample mixture 18 based upon one or more of the following equations:

Conservation of Mass:

$$\rho_1 u_1 A_1 + \rho_2 u_2 A_2 = \rho_3 u_3 A_3 \quad \text{(Eq. 1)}$$

Where ρ=density, u=specific internal energy and $A_n$=area.

Conservation of Momentum:

$$P_1 A_1 + \rho_1 u_1^2 A_1 + P_2 A_2 + \rho_2 u_2^2 A_2 = P_3 A_3 + \rho_3 u_3^2 A_3 \quad \text{(Eq. 2)}$$

Where P=static pressure, ρ=density, u=specific internal energy and $A_n$=area.

Conservation of Energy:

$$\dot{m}_1 h_{01} + \dot{m}_2 h_{02} = \dot{m}_3 h_{03} \quad \text{(Eq. 3)}$$

Where m=mass flow rate and h=specific enthalpy.

Figure 2:
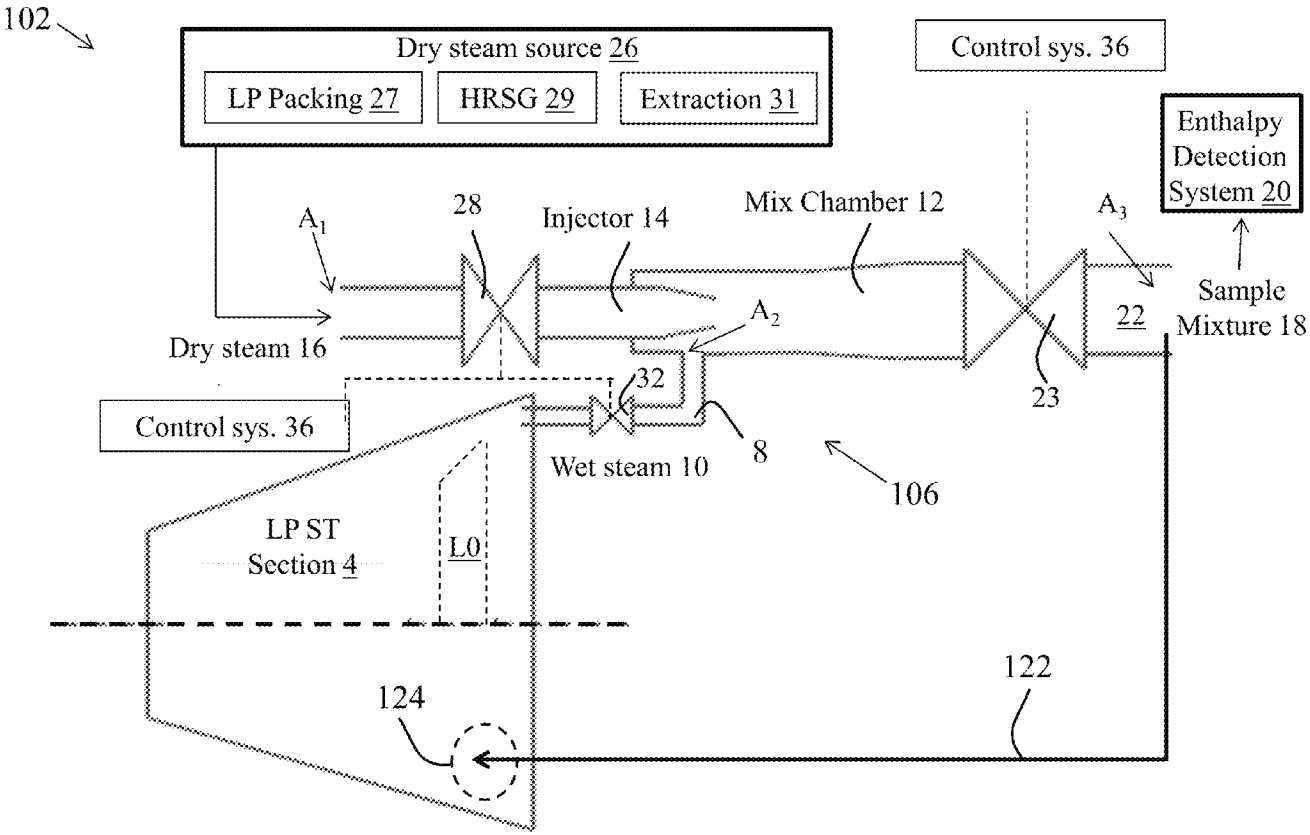
FIG. 2 shows a schematic depiction of a system according to various alternative embodiments of the invention.

Turning to FIG. 2, a system 102 and corresponding apparatus 106 are shown according to various alternative embodiments. In these embodiments, the apparatus 106 can include substantially similar components to the system 2 of FIG. 1, however, in this embodiment, apparatus 106 can include a return conduit 122 fluidly connecting the enthalpy detection system 20 with the steam turbine section 4. In these embodiments, the return conduit 122 can provide the sample mixture 18 to an inlet 124 of the steam turbine section 4. That is, the return conduit 122 can return steam (a mixture of the wet steam 10 and the dry steam 16 to the steam turbine section 4 at the inlet 124. In these cases, the steam turbine section 4 can utilize the sample mixture 18 to perform mechanical work, e.g., by forcing rotation of one or more stages of the steam turbine section 4. In some cases, the inlet 124 includes at least one of a last stage, a second-to-last stage or a third-to last stage of the steam turbine section 4.

Various embodiments of the invention relate to a method of determining the enthalpy of wet steam (e.g., wet steam 10) from a steam turbine section (e.g., LP steam section) 4. It is understood that the wet steam 10 can be extracted from any number of locations (one or more) on the steam turbine section 4 (e.g., a LP steam turbine section). In some cases, the wet steam 10 is extracted from a location of the steam turbine section 4 which is axially beyond the last-stage bucket (LSB) in the fluid flow path. In some cases, the wet steam 10 is extracted from a single location or multiple locations, in order to account for axial and/or radial differences in steam conditions within the exhaust of the steam turbine section 4 (if such axial and/or radial differences exist).

Figure 3:
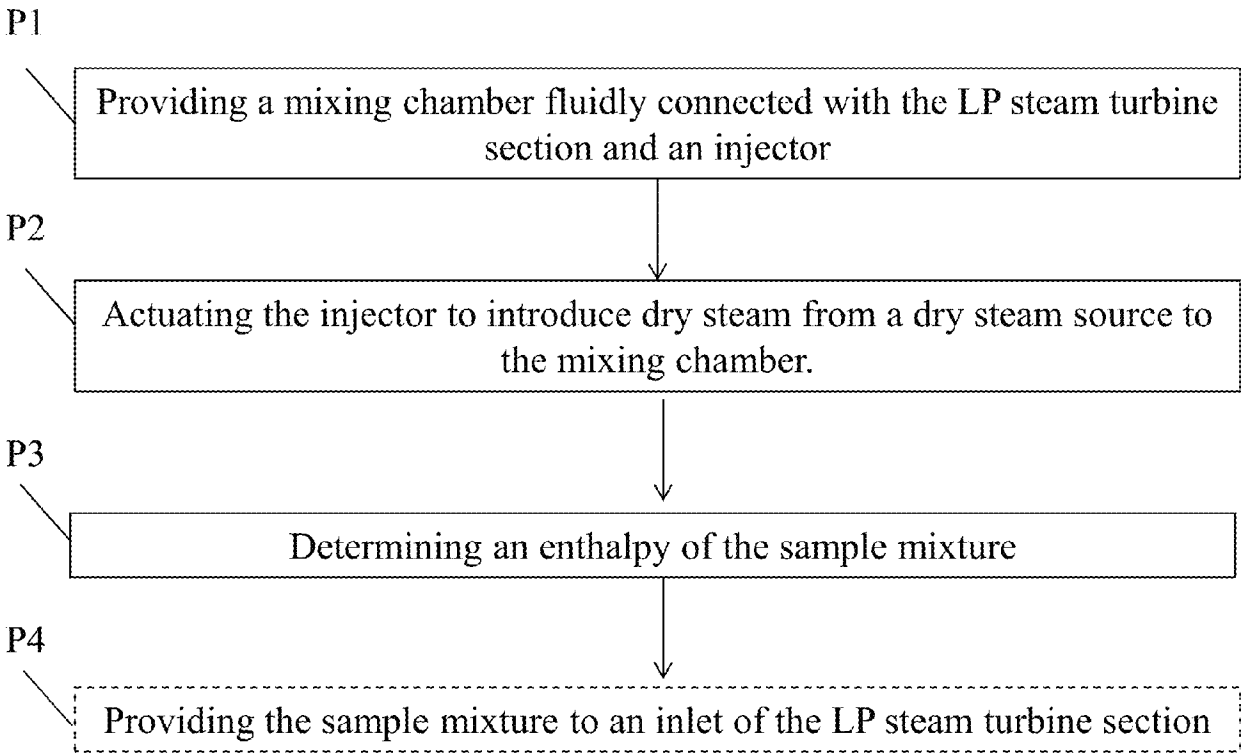
FIG. 3 shows a flow diagram illustrating a process according to various embodiments of the invention.

FIG. 3 shows an illustrative flow diagram including processes in a method of determining the enthalpy of wet steam from an LP steam turbine section. One having skill in the art will understand that the processes shown and described with reference to FIG. 3 can be applied to one or more systems similar to those shown and described with reference to FIG. 1 and/or FIG. 2. As shown, the method can include the following processes:

Process P1: providing a mixing chamber fluidly connected with the LP steam turbine section and an injector;

Process P2: actuating the injector to introduce dry steam from a dry steam source to the mixing chamber. As noted herein, actuating of the injector creates a vacuum condition within the mixing chamber, and this vacuum condition draws wet steam from the LP steam turbine section into the mixing chamber to mix with the dry steam and form a sample mixture;

Process P3: determining an enthalpy of the sample mixture; and

Process P4 (optionally): providing the sample mixture to an inlet of the LP steam turbine section. As described herein, the location of the inlet of the LP steam turbine section can include any suitable location for enhancing the performance of that LP steam turbine section, e.g., by utilizing the remaining potential energy of the sample mixture.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It is further understood that the terms "front" and "back" are not intended to be limiting and are intended to be interchangeable where appropriate.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. An apparatus comprising:

an extraction conduit fluidly connected with a steam turbine section, the extraction conduit for obtaining wet steam from the steam turbine section;

a mixing chamber fluidly connected with the extraction conduit;

an injector fluidly connected with the mixing chamber, the injector for providing dry steam to the mixing chamber for mixing with the wet steam from the steam turbine section to produce a sample mixture, wherein the injector creates a vacuum condition within the mixing chamber by providing the dry steam to the mixing chamber, and the vacuum condition draws the wet steam into the mixing chamber from the steam turbine section; and an enthalpy detection system fluidly connected with the mixing chamber, the enthalpy detection system configured to determine an enthalpy of the sample mixture.

2. The apparatus of claim 1, further comprising a dry steam source fluidly connected with the injector.

3. The apparatus of claim 2, further comprising a first control valve fluidly connected with the dry steam source and the injector, the first control valve for controlling flow of the dry steam from the dry steam source to the injector.

4. The apparatus of claim 3, further comprising a second control valve fluidly connected with the extraction conduit, the second control valve for controlling flow of the wet steam from the steam turbine section.

5. The apparatus of claim 4, further comprising a control system operably connected with the first control valve and the second control valve.

6. The apparatus of claim 5, wherein the control system is configured to modify a position of at least one of the first control valve or the second control valve.

7. The apparatus of claim 1, wherein the dry steam includes superheated steam.

8. The apparatus of claim 1, further comprising a return conduit fluidly connecting the enthalpy detection system with the steam turbine section, the return conduit for providing the sample mixture to an inlet of the steam turbine section.

9. The apparatus of claim 1, wherein the dry steam source includes at least one of an steam turbine section packing, a heat recovery steam generator (HRSG) or an extraction location of the steam turbine section.

10. A method of determining an enthalpy of steam from a steam turbine section, the method comprising:

providing a mixing chamber fluidly connected with the steam turbine section and an injector;

actuating the injector to introduce dry steam from a dry steam source to the mixing chamber, the actuating of the injector creating a vacuum condition within the mixing chamber, the vacuum condition drawing wet steam from the steam turbine section into the mixing chamber to mix with the dry steam and form a sample mixture; and determining an enthalpy of the sample mixture.

11. The method of claim 10, further comprising providing the sample mixture to an inlet of the steam turbine section.

12. The method of claim 11, wherein the providing of the sample mixture to the inlet includes providing the sample mixture to at least one of a last stage, a second-to-last stage or a third-to-last stage of the steam turbine section.

13. The method of claim 10, wherein the actuating of the injector includes actuating a control valve fluidly connected with the injector and the dry steam source.

14. The method of claim 10, wherein the dry steam source includes at least one of an steam turbine section packing, a heat recovery steam generator (HRSG) or an extraction location of the steam turbine section.

15. A system comprising:

a steam turbine section;

an extraction conduit fluidly connected with the steam turbine section, the extraction conduit for obtaining wet steam from the steam turbine section;

a mixing chamber fluidly connected with the extraction conduit;

an injector fluidly connected with the mixing chamber, the injector for providing dry steam to the mixing chamber for mixing with the wet steam from the steam turbine section to produce a sample mixture, wherein the injector creates a vacuum condition within the mixing chamber by providing the dry steam to the mixing chamber, and the vacuum condition draws the wet steam into the mixing chamber from the steam turbine section; and an enthalpy detection system fluidly connected with the mixing chamber, the enthalpy detection system configured to determine an enthalpy of the sample mixture.

16. The system of claim 15, wherein the dry steam is provided to the mixing chamber at a lower pressure than the wet steam.

17. The system of claim 15, further comprising a return conduit fluidly connecting the enthalpy detection system with the steam turbine section, the return conduit for providing the sample mixture to an inlet of the steam turbine section.

18. The system of claim 17, wherein the inlet of the steam turbine section includes at least one of a last stage, a second-to-last stage or a third-to-last stage of the steam turbine section.

* * * * *